United States Patent [19]

Montgomery

[11] 4,220,330

[45] Sep. 2, 1980

[54] ARM WRESTLING REFEREE DEVICE

[76] Inventor: Theophalus S. Montgomery, 2710 West Ogden, Apt. 405, Chicago, Ill. 60608

[21] Appl. No.: 919,934

[22] Filed: Jun. 28, 1978

Related U.S. Application Data

[63] Continuation-in-part of Ser. No. 765,965, Feb. 7, 1977, abandoned.

[51] Int. Cl.[2] ..... A63F 9/00

[52] U.S. Cl. ..... 273/1 E; 273/DIG. 26

[58] Field of Search ..... 272/67, 116; 273/1 O, 273/1 T, 1 U

[56] References Cited

U.S. PATENT DOCUMENTS

| | | | |
|---|---|---|---|
| 3,649,010 | 3/1972 | Jeffery | 273/67 |
| 3,735,983 | 5/1973 | Ortiz | 273/1 O |
| 4,131,275 | 12/1978 | Gandy | 272/67 |

OTHER PUBLICATIONS

*Arm Wrestler, Popular Science,* p. 83, Nov. 1975.

*Primary Examiner*—Richard C. Pinkham

*Assistant Examiner*—R. Carl Moy

*Attorney, Agent, or Firm*—Neuman, Williams, Anderson & Olson

[57] ABSTRACT

An electronic device for refereeing an arm wrestling match is provided which includes a housing within which an electronic circuit is disposed including appropriate sensors, indicator devices, a power supply, and other electronic components with the upper surface of the housing forming a playing surface. Several light and sound emitting devices, a digital clock, and a digital scoreboard are provided for regulating play. Sensors are provided for detecting one player's hand being forced to the playing surface as well as the premature lifting of one player's elbow. The device automatically starts the match shortly after both player's elbows are set, detects infractions committed by a player as well as successful endeavors on the part of one player to force the other player's hand to the surface and attributes points accordingly. In addition, it maintains the score of each player as well as the elapsed time, and provides numerous audio and visual indications during and after the match.

21 Claims, 7 Drawing Figures

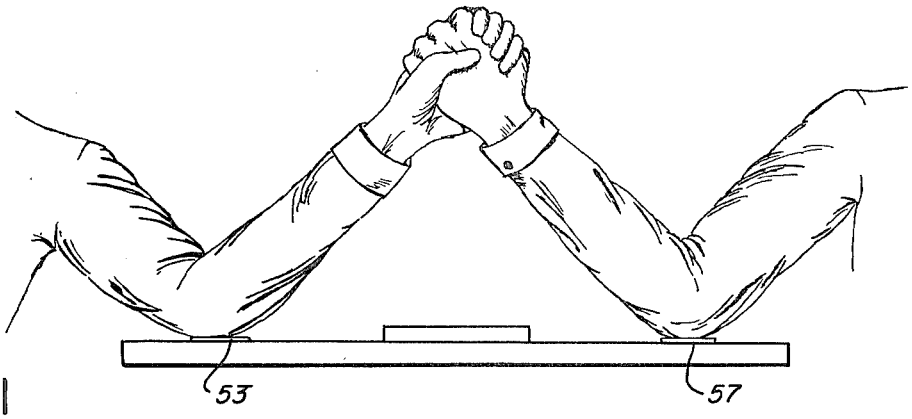
FIG. 1
FIG. 2
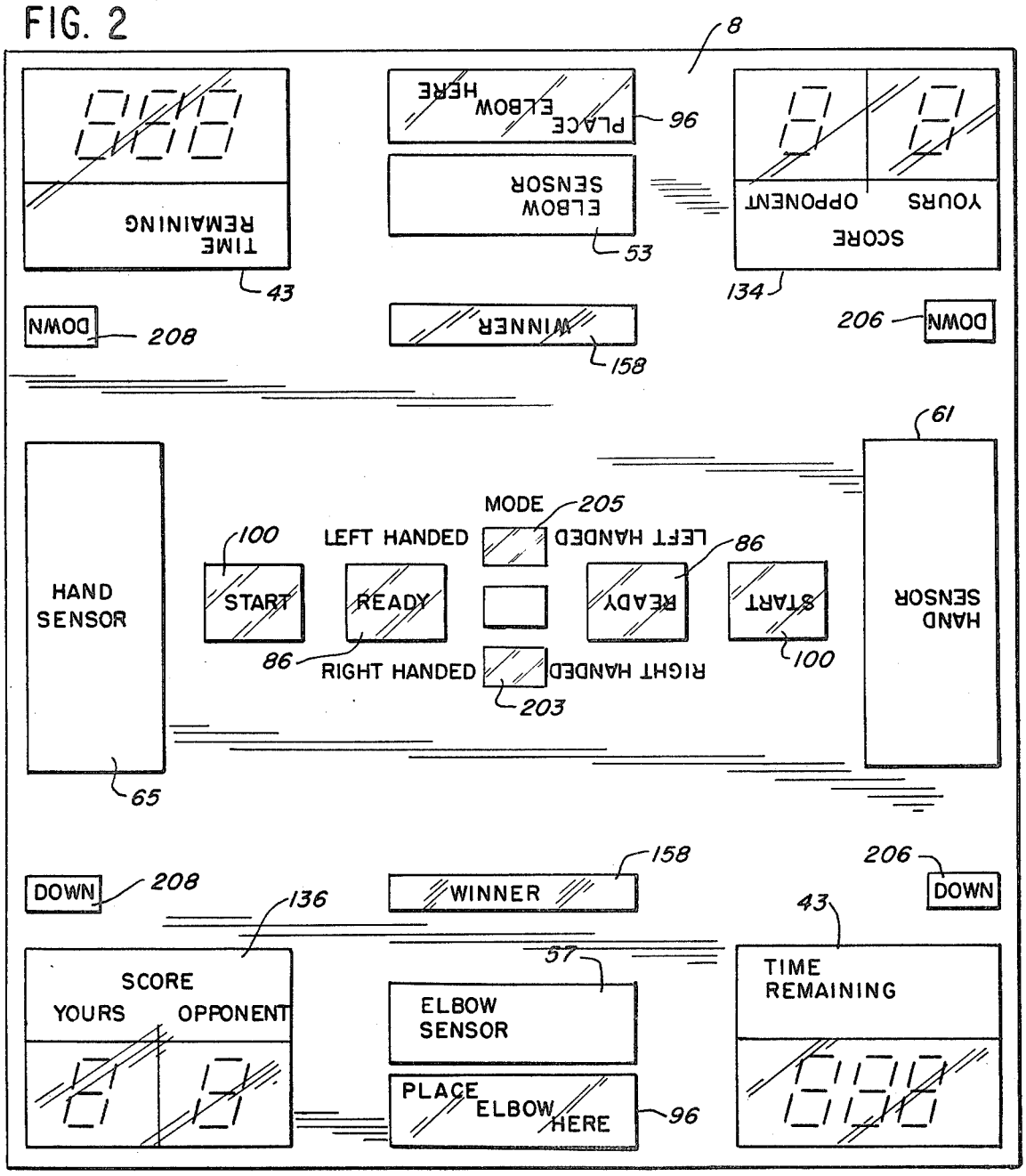

FIG. 3
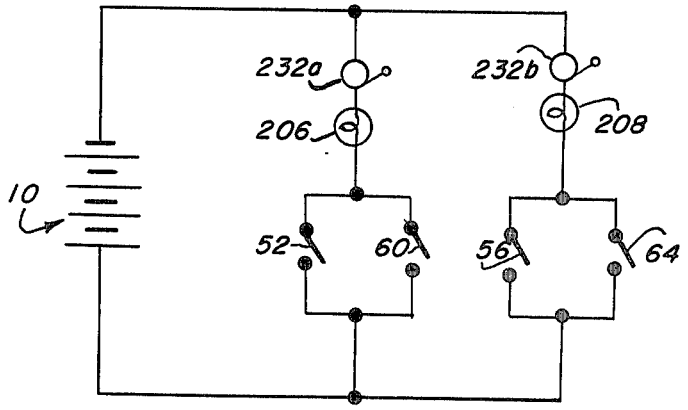
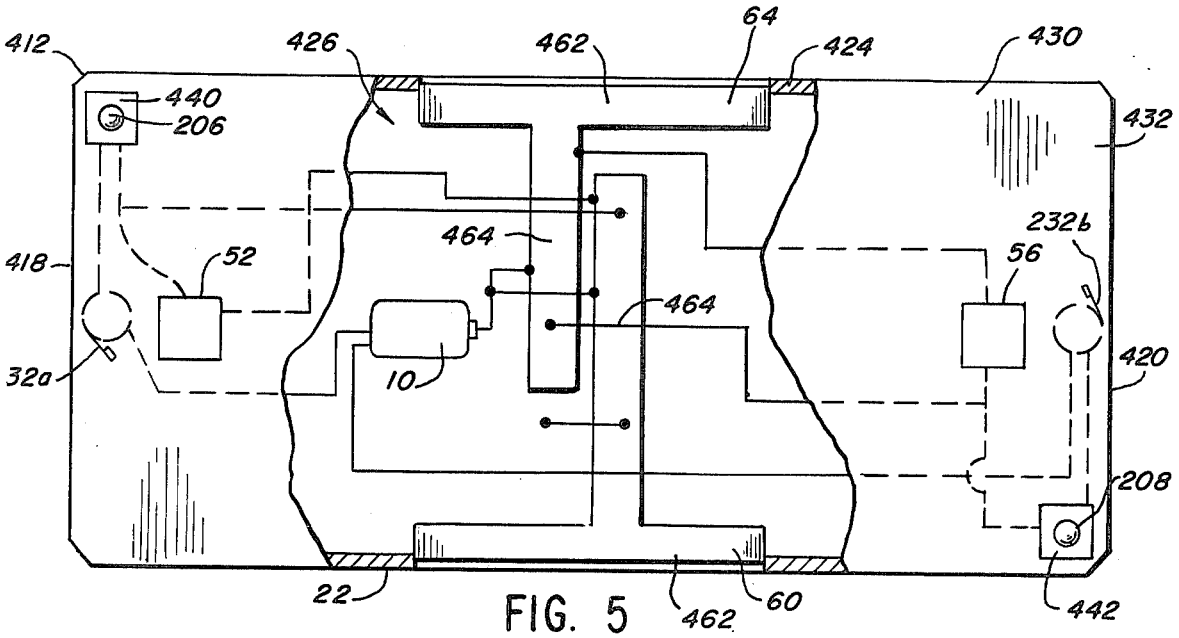
FIG. 5
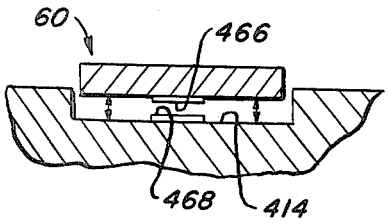
FIG. 7
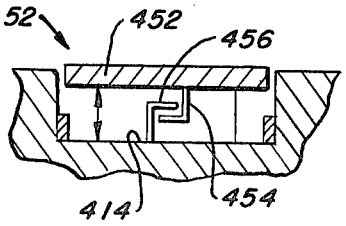
FIG. 6

ARM WRESTLING REFEREE DEVICE

RELATED CASE

This application is a continuation-in-part of my copending application Ser. No. 765,965, now abandoned filed Feb. 7, 1977.

BACKGROUND OF THE INVENTION

This invention relates generally to devices employed to referee an arm wrestling match and more particularly to electrical or electronic devices which automatically regulate match play in addition to providing several features.

A number of U.S. patents relate to variously designed arm testing devices, but these are nonapplicable to the arm wrestling referee device of applicant's present invention. These U.S. Pat. Nos. are: 911,925 to Zeno; 3,467,376 to Feinberg; 3,633,907 to Cane; and 3,662,602 to Weiss.

Currently available arm wrestling referee devices provide, at most, an indication when one player has forced the other's hand to rest on a prescribed area. No mechanism is provided to detect one player's attempt to obtain an unfair advantage by lifting an elbow from the playing surface. The recent upsurge in popularity of arm wrestling and a dramatic increase in the level of competition has increased the desirability of more adequate arm wrestling referee devices which overcome the disadvantage of such devices previously known.

Arm wrestling championship tournaments are being conducted throughout the country. Some of the matches have received nationwide television coverage. These matches are typically referred by a single official. Frequent elbow lifting infractions go unnoticed as it is extremely difficult to watch for contact of one player's hand to the surface while simultaneously being attentive to the lifting of the other player's elbow.

This problem is further exaggerated by the fact that an elbow may only be slightly lifted from the surface making detection, by all but the most astute observer, virtually impossible. Yet none of the prior art devices offer a solution to this problem.

In addition, the prior art devices are cumbersome in that typically the device must be set up or properly anchored to operate effectively. No portable lightweight self-contained unit is provided thereby creating a disincentive to utilize such devices.

In short, the problem has been to provide an easy to use arm wrestling referee device that is capable of detecting elbow infractions as well as hand pins.

OBJECTS OF THE INVENTION

It is an object of the present invention to overcome the problems, shortcomings and disadvantages of prior devices.

It is another object of the present invention to provide an arm wrestling referee device capable of detecting each occurrence whereby a player lifts an elbow from the playing surface.

Another object of the present invention is to provide an arm wrestling referee device capable of detecting hand pins as well as elbow infractions.

A further object of the present invention is to provide an arm wrestling referee device with the capability of providing an audio as well as a visual indication whenever a player's hand is pinned to or an elbow lifted from the playing surface.

A still further object of the present invention is to provide a lightweight, portable esthetically pleasing arm wrestling referee device.

Yet another object of the present invention is to provide an arm wrestling referee device that is ready and easy to use requiring no assembly.

Other objects of the invention will become apparent upon reading the following detailed description with reference to the drawings.

SUMMARY OF THE INVENTION

This device was created with the general object of overcoming the disadvantages of prior arm wrestling referee devices and the further object of providing a device highly capable of overseeing an arm wrestling match.

In a device constructed in accordance with the invention, a housing is provided which defines a playing surface and includes sensors supported by the housing, electrical switches actuated by the sensors and disposed within the housing, indicators suitably located in the housing, a power supply, and circuitry which appropriately interconnects the switches, the power supply and the indicators whereby the several elements cooperate to referee an arm wrestling match.

The housing includes two sets of sensors with each set including two sensors, one sensor of each set for each participant. One set of sensors is effective in the determination of whether or not one participant has lifted an elbow from the playing surface. The other set of sensors is effective in the determination of whether a player's hand has been forced to the playing surface. In the preferred embodiment, the sensors are padded to minimize discomfort to the participants.

The sensors actuate electrical switches located within the housing. These switches may be normally open or normally closed without departing from the scope of the invention. In the preferred embodiment, nonlocking contact switches are utilized. The switches are mounted between the sensors and the housing so that movement of the sensors causes actuation of the switch. Nonmechanical heat sensitive or body capacitance type switches could be employed as sensor-switches as well without departing from the scope of the invention.

The switches are connected to and monitored by circuit means. The circuit means is also connected to indicator means and is operable when energized by a power supply to provide audio-visual indications of the status of the match.

The power may be supplied via a direct line connection to house current or by portable batteries. In the preferred embodiment, power is supplied by house or line current.

BRIEF DESCRIPTION OF THE DRAWINGS

FIG. 1 is a side view of the preferred embodiment with participant's arms shown in place as environment;

FIG. 2 is a top plan view of the preferred embodiment;

FIG. 3 is a circuit diagram of an embodiment of this invention disclosing the principals thereof;

FIG. 5 illustrates a top partial cross-section view of an embodiment of this invention using the circuitry of FIG. 3;

FIG. 6 illustrates a side cross-sectional view of a first electrical switch member of the embodiment of FIG. 5; and FIG. 7 illustrates a side cross-sectional view of a second electrical switch member of the embodiment of FIG. 5.

DETAILED DESCRIPTION OF THE PREFERRED EMBODIMENT

Figure 4:
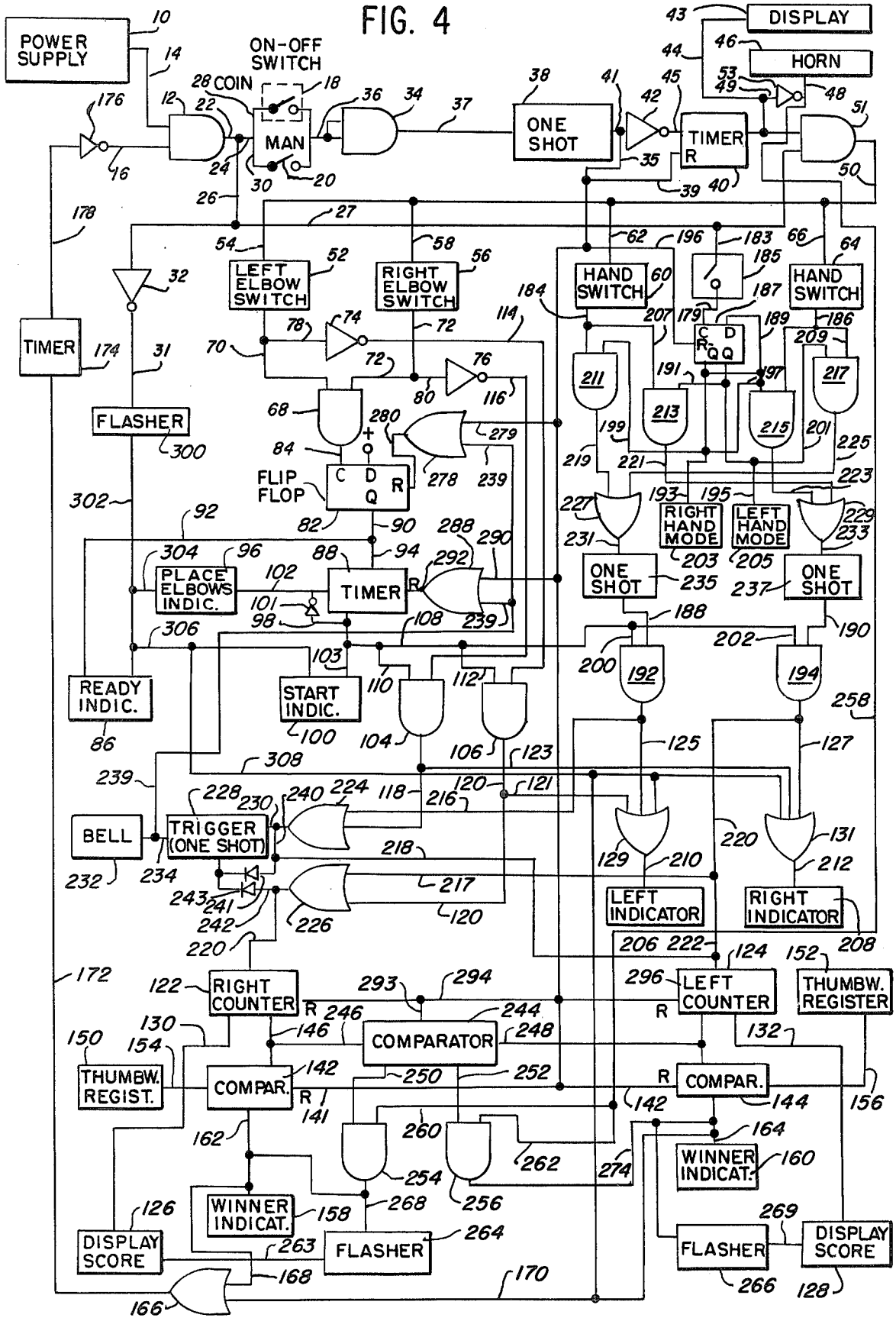
FIG. 4 is a block diagram of the preferred embodiment.

In general, the operation of the preferred embodiment of my invention as shown in FIGS. 1 and 2 is as follows: The participants assume the position shown in FIG. 1. The unit is activated by dropping a coin in a coin slot (not shown) or by activation of a manual normally open nonlocking switch. Each participant places an elbow on his respective one of two elbow sensors, 53 and 57. When both elbows are placed, the "ready" lamp indicators 86 are energized. If the elbows remain in place for a prescribed time period, i.e., four seconds, the "start" indicator lamps 100 are energized. At this point, the players will engage in a strenuous struggle to force each other's hands into contact with the respective one of two hand sensors 61 and 65 while maintaining their elbows in contact with the elbow sensors 53 and 57. Each player is provided with an indication as to whether his hand or his opponent's hand has been downed by virtue of the "down" indicator lamps 206 and 208. In addition, a player's "down" indicator lamps 206 or 208 will also be energized in the event that he lifts his elbow from the playing surface after the "start" indicator lamps 100 have been energized.

Should one's hand be successfully forced into contact with one of the hand sensors or should an elbow be lifted from one of the elbow sensors after the "start" indicator lamp has been activated, one of two digital counter displays 134 and 136 will be advanced accordingly and a bell energized. From the point in time that a coin is dropped in the coin slot or the unit is turned on by the activation of the manual switch, a clock begins to run and indicators 43 show the time remaining in the match. Should one player's hand be downed or elbow be lifted a prescribed number of times, a bell will be activated as well as the lamp indicating the other player has won the match. In the event that the players have equal point totals at the end of the prescribed time period, a horn sounds indicating that sudden death play has begun wherein the first player to have pinned the hand of his opponent or to cause his opponent to lift his elbow will be deemed the winner of the match. After a winner indication has been made the circuit is once again deactivated and the indicator lamps will be intermittently energized by a circuit provided for the sole purpose of giving a nonoperational visual effect. What follows is a more detailed description of the preferred embodiment.

In FIG. 3, the principal elements of the control circuit of the embodiment is shown. A power supply 10 is connected in parallel with the two identical series-parallel subcircuits. The negative battery terminal is connected to one terminal of electrical bells 232*a* and 232*b*. The bells 232*a* and 232*b* are connected in series with lamps 206 and 208. The lamp 206 is connected in series with a set of switches 52 and 60 which are connected in parallel with each other. Switch 52 is a nonlocking normally closed elbow switch. It is connected in parallel with a nonlocking normally open hand switch 60. One common terminal between switches 52 and 60 is connected to lamp 206. The other common terminal between switches 52 and 60 is connected to the positive terminal of the battery 10, as shown.

Similarly, the negative terminal of the battery 10 is connected to one terminal of the bell 32*b* which is provided in series with the lamp 208. The remaining terminal of the lamp 208 is connected to the parallel network of switches 56 and 64. The switch 56 is a normally closed nonlocking elbow switch. It is in parallel with a nonlocking normally open hand switch 64. The remaining common terminal between the switches 56 and 64 is connected to the positive terminal of the battery 10, as shown. Switches 56 and 64 comprise the set of switches corresponding to the second participant.

In FIG. 4, the various elements of the control circuit 6 of the preferred embodiment of the invention are shown in block diagram form. The block diagram of FIG. 4 depicts only the interconnections necessary to process input signals generated during play. Not shown are numerous connections between the power supply 10 and the several components of the circuit. These connections are readily apparent and since they add nothing to the understanding of the invention, have been omitted to add clarity to the diagram.

The power supply 10 is shown connected to an AND gate 12 via a line 14. The power supply 10 may be either an ac-dc converter or a set of batteries, both of which are currently available. The power supply 10 is operative to supply a steady dc enabling signal to the AND gate 12.

The AND gate 12 has inputs 14 and 16 and is operative to pass the enabling signal on input line 14 from the power supply 10 to its output whenever a sufficiently high dc level is present at its second input line 16. As discussed more fully below, the AND gate 12 operates to pass the enabling signal from the power supply 10 to the on-off switches 18 and 20 until a determination is made that one participant has won the match. The output of the AND gate 12 appears on a line 22. Line 22 is connected to lines 24 and 26. The output of the AND gate 12 is applied to the on-off switches 18 and 20 via lines 24, 28 and 30.

The on-off switch 18 is operated by the insertion of a coin. Coin operated switches are readily available. The on-off switch 20 is operated manually. The parallel connection of the switches 18 and 20 allows the unit to be activated either manually or by coin. The activation of either switch 18 or 20 completes an electrical connection between the AND gates 12 and 34 via line 36. Note that the AND gate 34 has its inputs tied together. In this arrangement, the AND gate 34 operates as a buffer and provides an appropriate dc signal to a pulse generator or one shot 38 via the line 37.

The one shot 38 is connected to an inverter 42 via a line 41. The inverter 42 is connected to the timer 40 via a line 45. The one shot 38 is also connected to the reset pin R of the timer 40 via the lines 35 and 39. As discussed more fully below, the one shot 38 is operative to reset several circuit components with a logical "1" output pulse. When the pulse ends, the output of the one shot 38 will be low, the output of the inverter 42 will be high, and the timer 40 will be started, thereby starting a new cycle.

The timer 40 is connected to a display 43 via the line 44 and an inverter 53 via a line 49. The inverter 53 is connected to a horn 46 via the line 48 and the AND gates 254 and 256 via a line 258. During a prescribed time period, the output of the timer 40 is high, and the AND gate 51 is enabled. After the prescribed time period, the output of the timer 40 is low and the horn 46 is energized via the converter 53. Where, not shown, it is understood and apparent to one of ordinary skill in the art that the audio/visual displays, i.e., the horn 46, are powered by driver circuits. Similarly, the AND gates 254 and 256 are enabled when the output of the timer 40 is low. Power supplies, AND gates, one shots and display timers or clocks are readily available and will not be described in detail here.

The timer 40 is connected to one of two inputs to an AND gate 51. The second input to the AND gate 51 is provided by the output of the AND gate 12 via the lines 22, 26, and 27. A line or bus 50, to which each of the elbow and hand switches are connected, is connected to the output of the AND gate 51.

A left elbow switch 52 is connected to the bus 50 via a line 54. A right elbow switch 56 is connected to the bus 50 via a line 58. A left hand switch 60 is connected to the bus 50 via a line 62, and a right hand switch 64 is connected to the bus 50 via the line 66. The switches 52, 56, 60 and 64 are disposed beneath padded sensors 53, 57, 61 and 65, respectively so that the switches are actuated by hand or elbow placement or removal from the sensors. The switches are currently available non-locking normally open momentary contact single-pole single-throw switches. Heat sensitive switches, touch sensitive switches, or the like may be used as well without departing from the scope of the invention. When the switches are operated, a signal is generated which serves to indicate various conditions of play. The left and right elbow switches 52 and 56 are connected to the inputs of a two input AND gate 68 via lines 70 and 72, respectively. Similarly, the left and right elbow switches 52 and 56 are connected to inverters 74 and 76 via lines 78 and 80, respectively. When the left and right elbow switches 52 and 56 are depressed simultaneously, high voltage levels appear on lines 70 and 72. This causes the output of the AND gate 68 to go to a high voltage level. The clock input of a D-type flip-flop 82 is connected to the AND gate 68 via a line 84. The flip-flop 82 is set to be triggered by a high voltage level on the line 84 by coupling its data input to a positive potential source. When this occurs, the "Q" output of the flip-flop 82 will go high which will cause a "ready" lamp indicator 86 to glow and a four second timer 88 to start. The "Q" output of the flip-flop 82 is connected to the ready lamp indicator 86 via leads 90 and 92 and to the four second timer 88 via leads 90 and 94. The four second timer 88 is connected to a "place elbows" indicator lamp 96 via a line 98, an inverter 101, and a line 102 and a start indicator lamp 100 via a line 103. The timer 88 is arranged so that a low output level appears on the lines 98 and 103 until a count of four seconds is reached whereupon the lines 98, 103 have high level voltages; whereupon by virtue of the inverter 101, the line 102 has a low level voltage. In short, after four seconds, the "place elbows" lamp goes out and the start lamp lights. The count of four seconds was chosen arbitrarily to give the participants an opportunity to be set before the match begins. Any time period may be chosen without departing from the scope of the invention. The output of the timer 88 provides an enabling signal to each of two two input AND gates 104 and 106 via lines 103, 108, 110 and 112. The other input to the AND gates 104 and 106 is supplied via lines 114 and 116 which are connected to the outputs of the inverters 74 and 76, respectively. This circuit operates to cause a high level voltage to appear on the output lines 118 and 120 of AND gates 104 and 106 whenever the timer 88 has reached the prescribed count, here four seconds, and one of the participants subsequently lifts an elbow off a sensor 53 or 57, thereby deactivating a switch 52 or 56.

The outputs of AND gates 104 and 106 provide one input to two input OR gates 224 and 226, respectively. These inputs represent signals corresponding to elbow infractions. Signals corresponding to hand pinnings, as discussed more fully below, provide the second input to the OR gates 224 and 226, via lines 216 and 217. The output of the OR gates 224 and 226 is applied to corresponding score-keeping circuitry via lines 218 and 220, respectively. Through the OR gates 224 and 226, the outputs of the switches is selectively applied to the appropriate counting circuitry.

As mentioned above, the second input to the two input OR gates 224 and 226 is provided by the hand switch circuitry. The left hand switch 60 and the right hand switch 64 are disposed below hand sensors 61 and 65 and connected to the bus 50 via lines 62 and 66, respectively. The hand switches 60 and 64 are connected to the mode circuitry composed of a mode switch 185, a "D" type flip-flop 187, AND gates 211, 213, 215, and 217, OR gates 227 and 229, and indicator lamps 203 and 205. The hand switch 60 is connected to the AND gate 211 by a line 184 and to the AND gate 213 by the lines 184 and 207. Similarly, the hand switch 64 is connected to the AND gate 215 by a line 186 and an AND gate 217 by the lines 186 and 209. The second input to each of the AND gates 211, 213, 215, 217 is provided by the "Q" and "$\overline{Q}$" outputs of the flip-flop 187 as shown. The AND gate 211 is connected to the "$\overline{Q}$" output of the flip-flop 187 by the line 199. AND gate 213 is connected to the "Q" output of the flip-flop 187 by a line 191. The AND gate 215 is connected to the "$\overline{Q}$" output of the flip-flop 187 by a line 197 and the AND gate 217 is connected to the "Q" output of the flip-flop 187 by a line 201. The mode switch 185 is provided to activate the flip-flop 187. The mode switch 185 is a single pole, single throw momentary contact switch preferably of the pushbutton variety. One side of the switch 185 is connected to line 27 via line 183 so that there will always be a high level voltage on one side of the switch 185 while the game is in progress. The other side of the switch is connected to the flip-flop 187 by a line 179. The line 179 terminates on the "C" input of the flip-flop 187. Flip-flop 187 being of the "D" type, transfers the logical input on the "D" port to the "Q" output port whenever a clock pulse appears at the "C" input port. The "Q" port of the flip-flop 187 is connected via line 195 to the left-hand mode lamp 205.

The "$\overline{Q}$" port has an output that is always the opposite of the output of the "Q" port. That is, if "Q" is high, "$\overline{Q}$" is low, and vice versa. The "$\overline{Q}$" port is connected to the "right-hand" mode lamp 203 via line 193. As the "$\overline{Q}$" port is tied to the "D" port via line 189, whatever the output of the "Q" port is at any instant, the opposite will be applied to the "D" port. Thus, the next instant that a pulse generated by the momentary closure of the mode switch 185, appears at the "C" port, the "$\overline{Q}$" output which is at present at the "D" input will be transferred to the "Q" output. In effect, the "Q" and "$\overline{Q}$" outputs will be constantly changing between and high and low values.

When the output of "Q" is high, AND gates 213 and 217 will be enabled and since the "$\overline{Q}$" output will be low, AND gates 211 and 215 will be disabled. In effect, the output of the hand switch 60 will be transferred via line 184 to the output of the AND gate 213 and into an OR gate 229 thereby activating a one shot 237 via line 233. Similarly, the output of the hand switch 64 will activate one shot 235 via enabled AND gate 217, OR gate 229 and line 231.

Similarly, if the "$\overline{Q}$" output were high, the "Q" output would be low and AND gates 211 and 215 would be enabled while AND gates 213 and 217 would be disabled. Note that the reset pin R of the flip-flop 187 is tied to the output of the reset one shot 38 via lines 35 and 196. Whenever the reset one shot 38 is activated, resetting various elements of the circuit, it also operates to reset the flip-flop 187. When the flip-flop 187 is reset the "Q" output is low and the "$\overline{Q}$" output is high. A high on the "$\overline{Q}$" output does two things, (1) it places a high on the "D" input so that when a pulse appears, the circuit automatically can be switched to the alternate mode and (2) it enables the AND gates 211 and 215 so that the circuit operates in the normal mode in that the hand switches 60 and 64 are tied via circuitry as explained more fully below to counters corresponding to right-handed players. It is readily seen that the output of the hand switches 60 will be diverted from the one shot 235 to the one shot 237 and the output of the hand switch 64 will be diverted from the one shot 237 to the one shot 235 upon the activation of the mode switch 185. In effect, switching occurs, and causes the outputs of the hand switches to be diverted from the counters associated with right-handed participants and allows the device to regulate the play between left-handed participants.

The outputs of the one shots 235 and 237 appear on lines 188 and 190, respectively. Lines 188 and 190 operate to connect the one shots 235 and 237 to one input of the two input AND gates 192 and 194. The second input to each AND gate 192 and 194 is provided by the output of the timer 88 via the lines 103, 108, 200 and 202. Therefore, after a prescribed time period, i.e., four seconds, the hand switches 64 are enabled so that an electrical connection may be provided between the switches and the score-keeping and displaying circuitry.

The outputs of the AND gates 192 and 194 are connected to one input of three input OR gates 129 and 131 via lines 125 and 127, respectively. A second input to each of the OR gates 129 and 131 is provided the outputs of the AND gates 104 and 106. The output of AND gate 106 corresponds to the left elbow switch 52 and is tied to OR gate 129 corresponding to the left-hand switch 60 via lines 120 and 121. Similarly, AND gate 104 corresponds to the right elbow switch 56 and is tied to OR gate 131 corresponding to the right-hand switch 64 via lines 118 and 123.

The third input to each of the OR gates 129 and 131 is connected to a flasher 300 via lines 302, 306, and 308 which is included to provide an attractive blinking of several visual indicators when the device is not being played.

The output of the OR gates 129 and 131 is tied to indicators 206 and 208 via lines 210 and 212, respectively. In effect, a visual indication is provided by indicators 206 and 208 whenever an elbow switch or a hand switch is activated.

As mentioned above, the second input to the two input OR gates 224 and 226 is provided by the outputs of the AND gates 192 and 194 via lines 216 and 217. Signals corresponding to the elbow switches 52 and 56 and the hand switches 60 and 64 are selectively coupled to score-keeping circuitry for the respective participants by the OR gates 224 and 226. The score-keeping circuitry will be discussed more fully below. The outputs of the OR gates 224 and 226 are also connected to a one shot 228 via lines 240 and 242 and diodes 241 and 243. The one shot 228, which, when triggered, energizes a bell 232 via a line 234 and resets a timer 88 via a line 239, OR gate 288 and line 278.

The score-keeping circuitry is composed of counters 122 and 124 which are provided to monitor the score of each participant. Counters are readily available and will not be described in detail here. The counters 122 and 124 are connected to OR gates 224 and 226 by lines 218 and 220. When a player lifts his or her elbow from a sensor 53 or 57 or allows his hand to be pinned to a hand switch 60 or 64, after the four second timer has reached its prescribed count, the output of the corresponding OR gate 224 or 226 goes high as discussed above, causing the corresponding counter 122 or 124 to be indexed appropriately. The output of each of the counters 122 and 124 is connected to the input to a digital display. The counter 122 is connected to a display 126 via a line 130. The counter 124 is connected to a display 128 via a line 132. As the counters 122 and 124 maintain the score of each participant, the score of each participant is continuously displayed throughout the match by the displays 126 and 128.

In addition, the outputs of the counters 122 and 124 are connected to an input of comparators 142 and 144 via lines 146 and 148, respectively. Also, the outputs of variable or thumb wheel registers 150 and 152 provide the remaining inputs to comparators 142 and 144 via lines 154 and 156, respectively. As known to the electronic arts the thumb wheel registers allow a count to be selected and stored for reference or comparison. Here the counts of the counters 122 and 124 are constantly and continuously compared to the count stored in the thumb wheel registers 150 and 152 to determine whether or not a player has amassed enough points to be deemed the winner of the match. The counts of the counters 122 and 124 are also constantly compared against each other by a comparator 244. The comparator 244 is connected to the right counter 122 by a lead 246 and the left counter 124 by a lead 248. The comparator 244 provides a high output voltage on the line 250 if and only if the count at the right counter 122 is greater than that of the left counter 124. Similarly, a high output appears on a lead 252 if and only if the count at the left counter 124 is greater than that of the right counter 122. As comparators are readily available, the design of the comparator 244 will not be described in detail here.

It should be noted that while a single line is shown as effectuating a connection between the comparators, registers and other circuit components, it is apparent to one of ordinary skill in the electronics art to provide either several parallel connections between the registers, counters, comparators, displays, etc. or single input and output lines with the exchange of signals being under the synchronous control of a clock not shown, without departing from the scope and teachings of the invention.

The outputs of comparator 244 are connected to one input of each of two two input AND gates 254 and 256 via lines 250 and 252, respectively. A second input is provided to each of the AND gates 254 and 256 by a connection to the timer 40 via lines 258, inverter 53, line 49 and line 44. The output of each AND gate 254 and 256 is connected to flashers 264 and 266 via lines 268 and 270. In addition, lines 272 and 274 provide a connection between the AND gates 254 and 256 and the "winner" indicator lamps 158 and 160, respectively, and OR gate 166 via lines 168 and 170. The comparator 244 cooperates with the timer 40 and AND gates 254 and 256 to select a winner after a prescribed time period in the event that neither player amasses enough points during the allotted time to win the match. The timer 40 provides a high voltage level on the output line 258 via inverter 53 whenever a prescribed time period has elapsed within which the players will have had a reasonable opportunity to defeat one another. The high voltage level appearing on line 258 operates to allow the high voltage appearing on either line 250 or 252 to be passed to the lamps 158 and 160 by the AND gates 254 and 256. In the event that the score is even as of this point, the circuitry operates to deem a player a winner if his opponent commits an elbow infraction or allows his hand to be pressed to the surface of the unit as when that occurs, the tie will be broken. Either AND gate 254 or AND gate 256 will have two inputs and therefore a high output. When this occurs, the corresponding "winner" indicator lamp will be activated and the deactivation circuitry, discussed below, OR gate 166, timer 174, and inverter 176, will operate to deactivate the circuit.

As the outputs of the comparators 142 and 144, and 244 are connected to "winner" indicator lamps 158 and 160 and to a timer 174 via lines 168 and 170, OR gate 166 and line 172, whenever one player is deemed a "winner", by a comparator the timer 174 is activated. The output of the timer 174 provides a high output level a prescribed time period after the "winner" indicator lamps have been activated. This signal is inverted by an inverter 176 via line 178. As a high on the input to the inverter 176 will cause a low on its output line 16, the AND gate 12 will be turned off. In effect, most of the circuit will be deactivated a prescribed time period after a "winner" indication has been made. However, since the output of the AND gate 12 is inverted by an inverter 32, via a line 26, flasher 33 is energized via a line 31. The flasher will operate to cause lamps 86, 96, 100, 206 and 208 to flash off and on to the attraction of the human eye.

When the circuit is reactivated, by switch 18 or switch 20, the one shot 38 will operate as described above to reset the timer 40 via the leads 35 and 39. It will also reset the flip-flop 82 via the leads 35 and 279, the OR gate 278, and its output line 280. The four second timer 88 is also reset by the one shot 38 via the leads 35 and 290, the OR gate 288, and line 292. The counters 122 and 124 are similarly reset by the lines 35, 294 and 296, respectively.

In operation, the device is set up for play by adjusting thumb wheel registers 150 and 152 so that on the attainment of predetermined scores, a winner indication will be made. After the power supply 10 has been energized, i.e., by making a connection to house or line current, the on-off switch 18 is energized by dropping a coin in the appropriate receptacle (not shown) or switch 20 is energized by operating the manual switch 20.

The participants assume the position shown in FIG. 1. Each participant places an elbow on a sensor 53 or 57 disposed on the playing surface 8. When both elbows are placed, the "ready" lamp indicators 86 are energized. If the elbows remain in place for four seconds the "start" indicator lamps 100 are energized. As described above, at this point the players will engage in a struggle to force each other's hands into contact with the hand sensors 61 and 65 disposed on the playing surface 8. Each player is provided with an indication as to whether his hand or his opponent's hand has been downed. This indication is provided by the down indicator lamp 206 and 208. In addition, should one's hand be successfully forced into contact with one of the hand sensors 61 or 65 or should an elbow be lifted from one of the elbow sensors 53 or 57 after the start indicator lamp 100 has been activated, one of the digital read-outs 134 or 136 will be energized accordingly. Throughout the match, the time remaining will be displayed by display 43.

What follows is a more detailed description of the operation of the circuit.

When the circuit is in a steady off state, the timer 174 has a low output and therefore the output of the inverter 176 is high. When the power supply 10 is activated, the AND gate 12 will have high inputs on lines 14 and 16 and therefore, a high output at line 22. Activation of switch 18 by insertion of a coin in the proper receptacle (not shown) or the switch 20 manually will operate to pass the high output of the AND gate 12 to the input of the buffer 34. As the buffer or AND gate 34 has inputs tied together, a high on line 36 will be passed to the output line 37. Line 37 will allow the high output of line 34 to be transferred to the input to the one shot 38. The one shot 38 will be activated. The activation of the one shot 38 will reset the timer 40, a flip-flop 82, the timer 88, the right counter 122, the left counter 124, the display 126, and the display 128. The one shot being a monostable multivibrator, will provide an output pulse of finite and prescribed duration. At the end of this pulse, the output of the one shot 38 will go low and the output of the inverter 42 will go high and start the timer 40. As the timer counts up to the prescribed count the output of the timer is high. As such, the AND gate 51 is enabled and operates to pass the high input on line 27 from the AND gate 12 to its output line or bus 50. In effect, the elbow switches 52 and 56 and the hand switches 60 and 64 are enabled. However, once the prescribed count has been reached by the timer 40, its output goes low and the output of the inverter 53 goes high. This operates to energize a horn 46 and enables AND gates 254 and 256. At this point, the output of the comparator as it appears on either line 250 or 252 is allowed to be passed to the "winner" indicator lamps 158 and 160 and the deactivation circuitry 166 and 174 as explained above.

As the timer 88 has not been activated by flip-flop 82, its output is zero. Thus, a high level voltage appears on line 102 by virtue of the inverter 101. In effect, the "place elbows" indicator lamp 96 is lit from the moment the power supply circuit 10 is energized. The "place elbows" indicator lamp 96 signals the participants to place their elbows on the elbow sensors 53 and 57. When both sensors 53 and 57 are depressed simultaneously, switches 52 and 56 are closed, AND gate 68 is activated, and the flip-flop 82 is energized. The flip-flop 82 starts the timer 88. If one of the participants lifts his elbow after the timer has reached a count as predetermined by design, i.e., four seconds, the output of the corresponding elbow switch is low which causes the output of either inverter 74 or 76 to go high which provides the additional high input that the AND gate 104 or 106 is seeking. The AND gate 104 or the AND gate 106 has a high output which is effective to trigger the one shot 228 and the bell 232 via OR gates 224 and 226 while simultaneously indexing the left or right counter 122 or 124 depending upon whether the left or right elbow switch 52 or 56 has been activated. The activation of the one shot 228 operates, in addition to activating the bell 232, to reset the timer 88 via the lead 235, the OR gate 288 and its output line 292. If the timer reaches its prescribed count without either participant committing an elbow infraction prior thereto or immediately thereafter, the output of the timer will be high which in addition to enabling the AND gates 104 and 106 will enable AND gates 192 and 194 and energize a start indicator lamp 100. When the "start" lamp lights, the participants will engage in a strenuous arm wrestling match to force the opponent's hand into contact with either the left or right hand sensors 61 or 65. If one of the participants is successful in doing so, his opponent's hand will activate a hand sensor 61 or 65. This will cause a hand switch 60 or 64 to have a high output which is communicated to one shots 235 or 237 via the AND/OR switching network composed of AND gates 211, 213, 215, and 217; OR gates 227 and 229, flip-flop 187 and switch 185. One shot 235 or 237 will be activated and provide a second high input high input to either AND gate 192 or 194. The output of the AND gate 192 or 194 will then be passed to a counter 122 or 124. In addition, the visual indicators 206 and 208 will be actuated as well as the bell 232 and the score displays 126 and 128. In the event that one player amasses enough points, as predetermined by the thumb wheel register 150, the comparator 142 will activate the "winner" indicator lamp 158 or 160 and start the deactivation timer 174. Should timer 40 reach a prescribed count before either player manages to win the match, the comparator 244 is enabled by AND gates 254 and 256 and operates to signal that the person who is ahead in the match has won the match. This is indicated by activation of the "winner" indicator lamps 158 and 160. In the event that the score is even after the timer 40 has reached the prescribed count, the sounding of the horn 46 will serve as a signal that the first player to commit an infraction or to allow his hand to be pinned loses.

An embodiment of this invention making use of the circuit of FIG. 3 is disclosed in FIGS. 5–7. This embodiment as shown in FIG. 5 includes an elongated rectangular box shaped housing 412 having a base 414 (not shown), a pair of upwardly extending end walls 418, 420, and upwardly extending front wall 422, an upwardly extending rear wall 424, a chamber 426 therein and top 430, wherein the top 430 is covered with a plastic decorative fabric 432 secured by adhesive means. A pair of bell members 232*a*, 232*b* are disposed in top 430. One of the members 232*a*, 232*b* is disposed at each end of housing 412. A pair of light sockets 440, 442 are disposed in the top 430. One of the sockets 440, 442 is disposed at each end of the housing 412, wherein a light bulb 206, 208 is removably received into sockets 440, 442 respectively. A battery means 10 is disposed in chamber 426. A pair of first electrical switch members 52, 56 as depicted in FIG. 6 is disposed in the center of top 430 at each end thereof. Members 52, 56 are of a pushbutton construction, wherein each is open until the button 452 is depressed downwardly. For each member 52, 56 a first L-shaped electrically conductive arm 454 is affixed to the base of button 452 and extends downwardly therefrom into the chamber 426. A second L-shaped electrically conductive arm 456 is affixed to an upper surface of base 414 and extends upwardly into the chamber 426, wherein arms 454, 456 engage, when pressure is released from button 452. When button 452 is depressed, electrical contact between arms 454, 456 is broken. As shown in FIG. 7, second electrical pushbutton switches 60, 64 are disposed in top 430 and is of a T-shaped configuration. Each switch 60, 64 is disposed on one of the sides of top 430, wherein the cross bar portion 462 extends along one of the sides of top 430 and the stem 464 extends inwardly towards the center of the top 430. A first T-shaped electrically conductive plate 466 as shown in FIG. 5 is affixed to the base of the button 468 of each switch 60, 64 as shown in FIG. 5. A second T-shaped electrically conductive plate 468 is affixed to the upper surface of base 414, under each plate 466. When one of the switches 60, 64 is depressed, the plates 466, 468 make electrical contact thereby closing of the switch 60, 64. A first electrical series circuit as shown in FIG. 3 consists of bell 232*a*, light 206, switch 52, switch 60, and battery means 10, wherein switch 60 is wired in parallel across switch 52. A second electrical series circuit consists of bell 232*a*, light 208, switch 56, switch 64 and battery 10, wherein switch 64 is wired in parallel across switch 56.

In use, one player places his elbow on button 452 of switch 52 and the other player places his arm on button 452 of member 56. When a player's elbow lifts off of one of the buttons 452 of one of the switches 52, 56, thereby closing contacts 454 and 456 or his arm depresses one of the switches 60, 64, thereby closing one of the circuits, one of the bells 232*a* or 232*b* will sound and lights 206 or 208 will glow thereby indicating the winner.

Thus, an apparatus and system is provided that effectively referees and facilitates an arm wrestling match and fulfills all aforementioned objects. While a particular embodiment of the invention has been shown, it will be understood, of course, that the invention is not limited thereto. Considering the foregoing teachings, modifications may be made, and other embodiments of the principals of this invention will occur to those skilled in the art to which the invention pertains. For example, as mentioned above, any of a variety of sensors and switches may be utilized to effectuate the sensing of the lifting of the elbow or the downing of a hand. Or, the circuit may be more economically designed, that is, the number of components may be reduced.

It is contemplated by the appended claims to cover any modification and any other embodiment which constitute the essential features of this invention.

I claim:

1. Apparatus for facilitating and refereeing an arm wrestling match between a plurality of participants comprising:

a housing defining a playing surface for at least two participants;

two sensor means spaced apart in said housing each including an elbow supporting surface supported by said housing to accommodate the elbows of two participants whereby said sensor means sense the presence of at least one player's elbow on said elbow supporting surface;

electrical switch means, indicator means and circuit means for each of said sensor means, said switch means being actuated by said sensor means and disposed within said housing, said indicator means suitably located in said housing, and said circuit means operatively interconnecting said switch means, said indicator means, and means for supplying power, whereby the presence of an elbow on said sensor means actuates said switch means to cause said indicator to provide a discernible indication thereof; and means actuated by the conditions of both sensor means to provide a further indication of which of the two elbows is raised from its respective sensor means first.

2. The apparatus of claim 1 including hand sensing means supported by said housing and spaced from each of said sensor means for sensing the presence of the respective participant's hand on said hand sensing means and switch means, indicator means and circuit means associated with each hand sensing means to indicate the presence of a hand thereupon.

3. The apparatus of claim 2 wherein said sensor means and said hand sensing means includes padded independently movable platforms mounted on resilient support means located between said platforms and said housing.

4. The apparatus of claim 3 wherein said electrical switch means includes nonlocking contact switches located between said platform and said housing whereby said switch is activated when a force is applied to or removed from said platform.

5. The apparatus of claim 2 wherein said circuit means includes switching means including a manually operable switch for selecting the desired mode of operation, electrical switching means activated by said manually operable switch and indication means for indicating the selected mode of operation for alternating the relationship between said electrical switches and the respective indication means whereby said apparatus device can accommodate left as well as right-handed play.

6. The apparatus of claim 1 wherein said indicator means includes a plurality of light and sound emitting devices to audibly and visually indicate the presence or absence of a player's elbow on a predetermined surface area and the presence or absence of a player's hand on a predetermined surface area and the termination of the match by virtue of one player accumulating a prescribed number of points within a prescribed time period and the termination of the match by virtue of the expiration of a prescribed time period.

7. The apparatus of claim 1 wherein said sensor means, circuit means and indicator means cooperate to provide a signal that the match is set to begin after the simultaneous application of forces to said sensor means.

8. The apparatus of claim 7 wherein said circuit means includes timing means whereby said circuit means and said indication means cooperate to provide an indication that the match has begun a prescribed time period after the match is set to begin.

9. The apparatus of claim 1 including means for energizing said indicator means when said apparatus is not being operated.

10. An apparatus for facilitating and refereeing an arm wrestling match between a plurality of participants comprising:

a housing defining a playing surface for at least two participants;

first sensor means supported by said housing for sensing the presence of at least one participant's elbow thereupon, said sensor means including padded independently movable platforms mounted on resilient support means located between said platforms and said housing;

second sensor means supported by said housing and spaced from each of said first sensor means for sensing the presence of the respective participant's hand on said second sensor means, said second sensor means including padded independently movable platforms mounted on resilient support means located between said platforms and said housing;

electrical switch means actuated by said sensor means and disposed within said housing;

indicator means suitably located in said housing and including a plurality of light and sound emitting devices;

means for supplying power;

and circuit means operatively interconnecting said switch means, said power supply means and said indicator means whereby the presence of an elbow on said sensor means actuates said switch means to cause said indicator to provide a discernible indication thereof.

11. The apparatus of claim 10 wherein said sensor means, circuit means and indicator means cooperate to provide an indication that the match is set to begin after the simultaneous application of forces to said first sensor means.

12. The apparatus of claim 11 wherein said circuit means includes timing means whereby said circuit means and said indication means cooperate to provide an indication that the match has begun a prescribed time period after the match is set to begin.

13. The apparatus of claim 10 wherein said circuit means includes electronic switching means, which cooperates with a manual switching means and an indication means whereby the relationship between said electrical switches and the respective indication means may be altered whereby said apparatus can accommodate left as well as right-handed play and provide an indication of the mode therein selected.

14. The apparatus of claim 10 including an electronic clock and indication means associated therewith whereby the time remaining in the match may be displayed.

15. The apparatus of claim 10 including means for displaying the point total of each player.

16. The apparatus of claims 2 or 10 wherein said circuit means includes means for storing electronic signals representing the number of times a participant lifts an elbow from said sensor means or allows a hand to be forced to the said sensor means which detects the presence of a hand.

17. The apparatus of claim 16 wherein said circuit means includes the means for comparing said electronic signals to a prescribed electronic signal.

18. The apparatus of claim 17 wherein said circuit means includes means for comparing the electronic signals corresponding to the score on each participant.

19. The apparatus of claim 18 wherein said circuit means includes means for displaying the electronic signals corresponding to each participant.

20. An arm wrestling referee device adapted to indicate electronically the winner of an arm wrestling match, which comprises:

(a) a housing having a base, a pair of upwardly extending end walls, an upwardly extending front wall, an upwardly extending rear wall, a top, and a chamber therein;

(b) switching means disposed in said top, one of said switching means disposed at each end of said top, each said switching means adapted to receive an elbow of one of the players, causing said switching means to be closed upon a placement of said elbow;

(c) sound emitting means disposed in said housing;

(d) light emitting means disposed in said housing;
(e) power supply means disposed in said chamber;
(f) and circuit means interconnecting said battery means, said switching means, said sound emitting means, and said light emitting means whereby the presence of an elbow on said switch means actuates said switch means to cause said indicator to provide a discernible indication thereof.

21. An arm wrestling referee device adapted to indicate electronically the winner of an arm wrestling match, which comprises:

(a) a housing having a base, a pair of upwardly extending end walls, an upwardly extending front wall, an upwardly extending rear wall, a top, and a chamber therein;
(b) a pair of first electrical pushbutton switch members disposed in said top, one electrical switch member disposed at each end of said top, each said first member adapted to receive an elbow of one of the players, causing each said first switch member to be closed upon a removal of said elbow;
(c) a pair of bell members disposed in said housing;
(d) a pair of light sockets with bulbs disposed in said housing;
(e) a battery means disposed in said chamber;
(f) a first series circuit of said battery means, one of said first switch members, one of said bell members, and one of said light sockets; and
(g) a second series circuit of said battery means, said other bell member, said other light socket, and said other first switch member.

* * * * *